US009348256B2

(12) United States Patent
Mitsui et al.

(10) Patent No.: US 9,348,256 B2
(45) Date of Patent: May 24, 2016

(54) IMAGE FORMING APPARATUS WITH VOLTAGE APPLYING DEVICE

(71) Applicant: CANON KABUSHIKI KAISHA, Tokyo (JP)

(72) Inventors: Yoshihiro Mitsui, Numazu (JP); Kodai Hayashi, Suntou-gun (JP); Hisashi Taniguchi, Suntou-gun (JP); Shuhei Kawasaki, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/640,606

(22) Filed: Mar. 6, 2015

(65) Prior Publication Data

US 2015/0253691 A1 Sep. 10, 2015

(30) Foreign Application Priority Data

Mar. 7, 2014 (JP) ..... 2014-044519

(51) Int. Cl.
*G03G 15/06* (2006.01)
*G03G 15/08* (2006.01)

(52) U.S. Cl.
CPC ..... *G03G 15/0812* (2013.01); *G03G 15/065* (2013.01)

(58) Field of Classification Search
CPC ..... G03G 15/065; G03G 15/0812
USPC ..... 399/55, 285
See application file for complete search history.

(56) References Cited

U.S. PATENT DOCUMENTS 5,697,028 A 12/1997 Kobayashi et al.
7,912,390 B2 3/2011 Mitsui
7,957,658 B2 6/2011 Mitsui
7,995,931 B2 * 8/2011 Inami et al. ..... G03G 15/081 399/55

(Continued)

FOREIGN PATENT DOCUMENTS

JP H08-227212 A 9/1996
JP 2002-229333 A 8/2002

(Continued)

OTHER PUBLICATIONS

Kodai Hayashi et al., U.S. Appl. No. 14/636,357, filed Mar. 3, 2015.

(Continued)

*Primary Examiner* — Wiliam J Royer
(74) *Attorney, Agent, or Firm* — Fitzpatrick, Cella, Harper & Scinto

(57) ABSTRACT

An image forming apparatus includes a detachably mountable developing device including a developer container, a developer carrying member, a feeding member, provided in contact with the developer carrying member, for supplying the developer to the developer carrying member, and a developer regulator; and a voltage device capable of applying to the developer carrying member and the developer regulator respective voltages different from each other. The image forming apparatus carries out, when a fresh developing device is mounted, an initial operation in which the developer carrying member is rotated. In the initial operation, the voltage device applies, to at least one of the developer carrying member and the developer regulator, a voltage for the initial operation which is different from the voltage for normal image forming operation, so as to urge a material applied to the developer carrying member in the fresh developing device toward the developer regulator from the developer carrying member.

16 Claims, 7 Drawing Sheets

(56) References Cited

U.S. PATENT DOCUMENTS

| | | | |
|---|---|---|---|
| 8,155,539 | B2 | 4/2012 | Kawasaki et al. |
| 8,346,104 | B2 | 1/2013 | Yoshida et al. |
| 8,548,344 | B2 | 10/2013 | Mitsui |
| 8,600,249 | B2 | 12/2013 | Kawaguchi et al. |
| 2010/0028025 | A1 | 2/2010 | Yoshida et al. |
| 2013/0287435 | A1 | 10/2013 | Yamamoto et al. |

FOREIGN PATENT DOCUMENTS

| | | | |
|---|---|---|---|
| JP | 2002-328569 | A | 11/2002 |
| JP | 2009-122406 | A | 6/2009 |
| JP | 2010-038972 | A | 2/2010 |
| JP | 2013-171284 | A | 9/2013 |
| JP | 2014-041204 | A | 3/2014 |

OTHER PUBLICATIONS

Yoshihiro Mitsui et al., U.S. Appl. No. 14/641,826, filed Mar. 9, 2015.

Kodai Hayashi et al., U.S. Appl. No. 14/641,816, filed Mar. 9, 2015.

Japanese Office Action dated Aug. 25, 2015, in related Japanese Patent Application No. 2014-044519.

* cited by examiner (a) EMBODIMENT 1

(b) EMBODIMENT 2

(a) EMBODIMENT 3

(b) COMPARATIVE EXAMPLE

| | APPLICATION AMOUNT & STREAK LEVEL | | | | | |
|---|---|---|---|---|---|---|
| | 5mg | 10mg | 30mg | 50mg | 70mg | 90mg |
| COMP. EX. | NG | NG | NG | NG | NG | NG |
| EMB. 1 | NG | F | F | G | G | G |
| EMB. 2 | F | F | G | G | G | G |
| EMB. 3 | G | G | G | G | G | G |

Fig. 7

IMAGE FORMING APPARATUS WITH VOLTAGE APPLYING DEVICE

FIELD OF THE INVENTION AND RELATED ART

The present invention relates to an image forming apparatus, such as a copying machine, a printer, a facsimile machine, and the like, which uses an electrophotographic or electrostatic recording method.

Conventionally, an electrophotographic image forming apparatus such as an electrophotographic copying machine, a laser beam printer, a facsimile machine, and the like, is equipped with a developing device. The developing device is provided with a developer container, a developer bearing member (development roller), and a developer regulating member (regulation blade). The developer bearing member is in the form of a roller. It is disposed in such a manner that it blocks the opening of the developer container while being partially exposed from the developer container through the opening. The developer regulating member is placed in contact with the peripheral surface of the developer bearing member to keep constant at a preset value, the amount by which the developer is conveyed by the developer bearing member, per unit area of the peripheral surface of the developer bearing member.

As the toner adhered to the peripheral surface of the development roller is conveyed through the area of contact between the development roller and regulation blade by the rotation of the development roller, the excessive amount of developer on the peripheral surface of the development roller is removed, and is returned to the developer container. Consequently, a thin and uniform layer of toner is formed on the development roller. At the same time, the toner is given triboelectric charge by the friction which occurs between the toner and regulation blade. Consequently, the toner on the development roller transfers from the development roller onto an electrostatic latent image formed on the peripheral surface of the photosensitive drum, in the area in which the development roller is exposed, from the developer container, while the photosensitive drum rotates, with its peripheral surface being virtually in contact with the peripheral surface of a development roller. Moreover, the developing device is provided with a developer supply roller (supply roller), a developer recovering member, and the like. The developer supply roller is placed in contact with the development roller, and is rotated at a preset speed which is different from the speed at which the development roller is rotated. The developer recovering member is for recovering the toner on the peripheral surface of the development roller.

Usually, a developing device delivered from a factory to a user is in the form of a cartridge (development cartridge). Thus, as a developing device becomes too short of toner to allow an image forming apparatus to continue an image forming operation, a user is to purchase a fresh developing device (development cartridge), which is removably installable in an image forming apparatus, and insert the cartridge into the apparatus to continue the image forming operation.

A fresh developing device is provided with a sealing member for preventing the toner in the developer container from leaking out of the developer container during the shipment of the developing device. This sealing member is not removed before the developing device is shipped out by a factory.

In the case of a fresh developing device, it sometimes takes a substantial length of time for the peripheral surface of the development roller to be sufficiently supplied with the toner in the developer container. If the development roller in a developing device is rotationally driven before the development roller is supplied with a sufficient amount of toner, the friction which occurs between the development roller and regulation blade as the developing device is driven, and the friction which occurs between the development roller and supply roller as the developing device is driven, become very large, making it possible for various components related to the driving of the developing device to be damaged, and/or the torque necessary to drive the developing device to become large enough to damage the mechanism for driving the developing device.

In Japanese Laid-open Patent Applications H08-227212 and 2002-229333, technologies for reducing a developing device in the amount of torque necessary to drive a developing device are proposed. According to these patent applications, before a fresh developing device is shipped out of a factory, powdery substance such as toner is applied as coating agent to the peripheral surface of its development roller in order to cause the powdery substance to function as lubricant.

However, in the cases of Japanese Laid-open Patent Applications H08-227212 and 2002-229333, the amount by which the development roller is coated with the coating agent is rather small. Thus, if a fresh developing device which requires a substantial length of time for the peripheral surface of its development roller to be sufficiently supplied with toner after it begins to be driven for the first time is used for the first time by an image forming apparatus, the image forming apparatus sometimes outputs images which suffer from "vertical streaks" right after it began to be used.

In a case where an image forming apparatus outputs images which suffer from vertical streaks, there are usually found foreign substances such as dust, paper burrs, and the like, sandwiched between the portions of the regulating edge of the regulation blade, which correspond in position to the locations of the vertical streaks of the images, and the peripheral surface of the development roller. These foreign substances disturb the thin toner layer on the peripheral surface of the development roller. Consequently, the image forming apparatus outputs images which suffer from vertical streaks.

In a case where the amount by which a development roller is coated with coating agent is small, the amount by which the coating agent is adhered to the portion (toner capturing portion) of the regulation blade, which is in the area of contact between the regulation blade and development roller, is very small immediately after a fresh developing device began to be driven. Thus, there occur gaps (portions which are not filled with coating agent) between the regulating edge of the regulation blade and the peripheral surface of the development roller, in terms of the lengthwise direction of the regulation blade.

In a case of a developing device which requires a substantial length of time for the peripheral surface of its development roller to be sufficiently supplied with toner after it begins to be driven, it takes a substantial length of time for the adjacencies of the capturing portion of its regulation blade to be sufficiently filled with toner. Thus, the developing device is driven for a relatively long time while the gaps are remaining in parts of the adjacencies of the capturing portion of the regulation blade and development roller. It is this period of time that the foreign substances such as dust, paper burrs, and the like, which were remaining adhered to the adjacencies of the regulation blade enter the gaps, and remain sandwiched between the regulation blade and development roller.

In order to prevent foreign substances such as dust, paper burrs, and the like from entering a developing device, the developing device production line has to be kept extremely clean. In order to keep the production extremely clean, it takes a large amount of labor and related cost. This in turn increases production cost, which is undesirable.

It is possible to increase the amount by which the peripheral surface of the development roller is coated with the powdery coating agent before the developing device is shipped out of a factory, in order to insure that there will be no gaps (areas which are not filled with coating agent) between the regulation blade and development roller. In such a case, however, the amount by which the peripheral surface of the development roller is coated with the coating agent has to be strictly controlled. That is, if it is not strictly controlled, the coating agent may scatter during the process in which the development roller is coated with the coating agent on the production line and/or while a developing device is transported after it is shipped out of the factory. Therefore, increasing the amount by which the peripheral surface of the development roller is coated with the coating agent is not desirable.

In order to minimize the length of time it takes for the peripheral surface of the development roller to be supplied with a sufficient amount of toner, some developing devices are not provided with a toner seal. In the case of these developing devices, it is possible for toner to leak from the toner container as described above. Therefore, providing a developing device with no toner seal is not desirable.

The present invention is made to solve the above-described problems. Thus, the primary object of the present invention is to provide an image forming apparatus which is capable of preventing the occurrence of image defects such as "vertical streaks" even if a fresh developing device which is relatively small in the amount of the coating agent on its development roller is installed in the main assembly of the apparatus.

SUMMARY OF THE INVENTION

The present invention is made in consideration of the above-described problems, and is a result of further development of conventional technologies.

According to an aspect of the present invention, there is provided an image forming apparatus comprising a developing device detachably mountable to a main assembly of said image forming apparatus, said developing device including a developer accommodating container for accommodating a developer, a developer carrying member for carrying the developer, a developer feeding member, provided in contact with said developer carrying member, for supplying the developer to said developer carrying member, a developer regulating member for regulating the developer carried on said developer carrying member; and a voltage applying device capable of applying to said developer carrying member and said developer regulating member respective voltages different from each other, wherein said image forming apparatus carries out, when a fresh developing device is mounted to said main assembly, an initial installing operation in which the developer carrying member is rotated, and wherein in the initial installing operation, said voltage applying device applies, to at least one of said developer carrying member and said developer regulating member, a voltage for the initial installing operation which is different from the voltage for normal image forming operation, so as to urge a material applied to said developer carrying member in the fresh developing device toward said developer regulating member from said developer carrying member.

Further features of the present invention will become apparent from the following description of exemplary embodiments with reference to the attached drawings.

BRIEF DESCRIPTION OF THE DRAWINGS

FIG. 7 is a table which shows a relationship between an amount by which the coating agent is applied, and the severity of vertical streaks, in each embodiment of the present invention, and also, in the case of the comparative developing device.

DESCRIPTION OF THE PREFERRED EMBODIMENTS

Hereinafter, preferred embodiments of the present invention are concretely described with reference to appended drawings. By the way, the dimensions, materials, and shapes of the structural components of the developing devices in the following embodiments of the present invention, and the positional relationship among the components, are not intended to limit the present invention in scope, unless specifically noted.

<Image Forming Apparatus>

Figure 1:
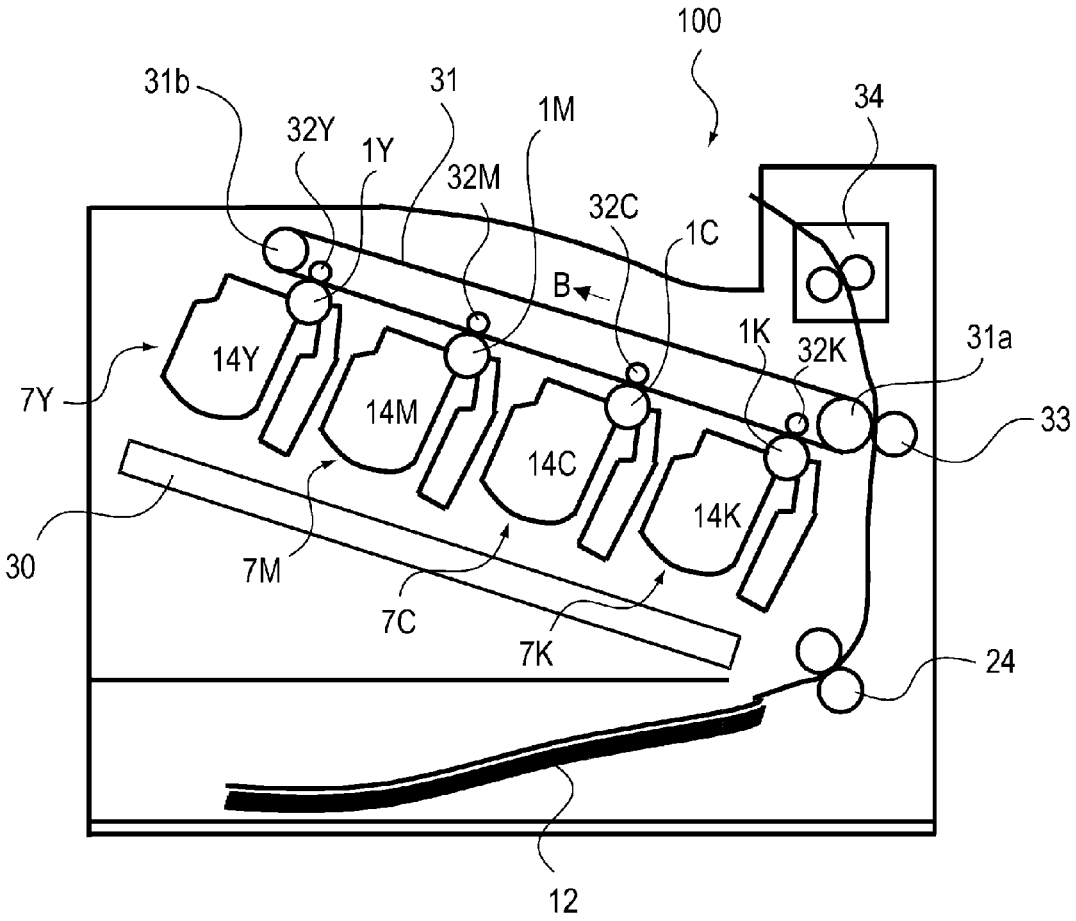
FIG. 1 is a sectional view of a typical image forming apparatus to which the present invention is applicable. It is for describing the structure of the apparatus.

To begin with, referring to FIG. 1, a typical image forming apparatus to which the present invention is applicable is described about its structure. An image forming apparatus 100 shown in FIG. 1 is an example of a full-color laser beam printer of the so-called inline type, and also, of the so-called intermediary transfer type. The image forming apparatus 100 can form a full-color image on a sheet of recording medium (recording paper, plastic, fabric, and the like) according to image formation information. The image formation information is inputted into a main assembly of the image forming apparatus 100 from an image reading device which is in connection to the main assembly of the image forming apparatus 100, or a host device such as a personal computer which is in connection to the main assembly of the image forming apparatus 100 in such a manner that communication is possible between the host device and the main assembly of the image forming apparatus 100.

The main assembly of the image forming apparatus 100 internally holds process cartridges 7Y, 7M, 7C and 7K which are removably installable in the main assembly. The process cartridges 7Y, 7M, 7C and 7K have image forming sections 14Y, 14M, 14C and 14K which are image forming means for forming yellow Y, magenta M, cyan C and black K images, respectively. The image forming sections 14Y, 14M, 14C and 14K in this embodiment are aligned in parallel and tandem in the direction (left-right direction) which is intersectional to the direction which is perpendicular to FIG. 1. By the way, for the sake of convenience, the image forming sections 14Y, 14M, 14C and 14K may be described as an image forming section 14. This will apply to the description of the other image processing means of the image forming apparatus 100 as well.

The process cartridge 7 is structured so that it can be removably installable in the main assembly of the image forming apparatus 100 through unshown cartridge installing means such as installation guides, positioning members, and the like, with which the main assembly of the image forming apparatus 100 is provided. In this embodiment, the four process cartridges 7 for forming monochromatic images, different in color, one for one, are the same in shape. A developer container 9 stores (contains) toner 10 (yellow Y, magenta M, cyan C and black K toners, as developer) one for one. The process cartridges 7 in this embodiment are described as a process cartridge which has: a developing device 3 as a development unit; and a photosensitive unit 13 having a photosensitive drum 1 as an image bearing member, which are integrally disposed in the shell of the process cartridge 7. However, the process cartridges 7 may be structured so that the developing device 3 is removably installable in the main assembly of the image forming apparatus 100, independently from the photosensitive unit 13.

Figure 2:
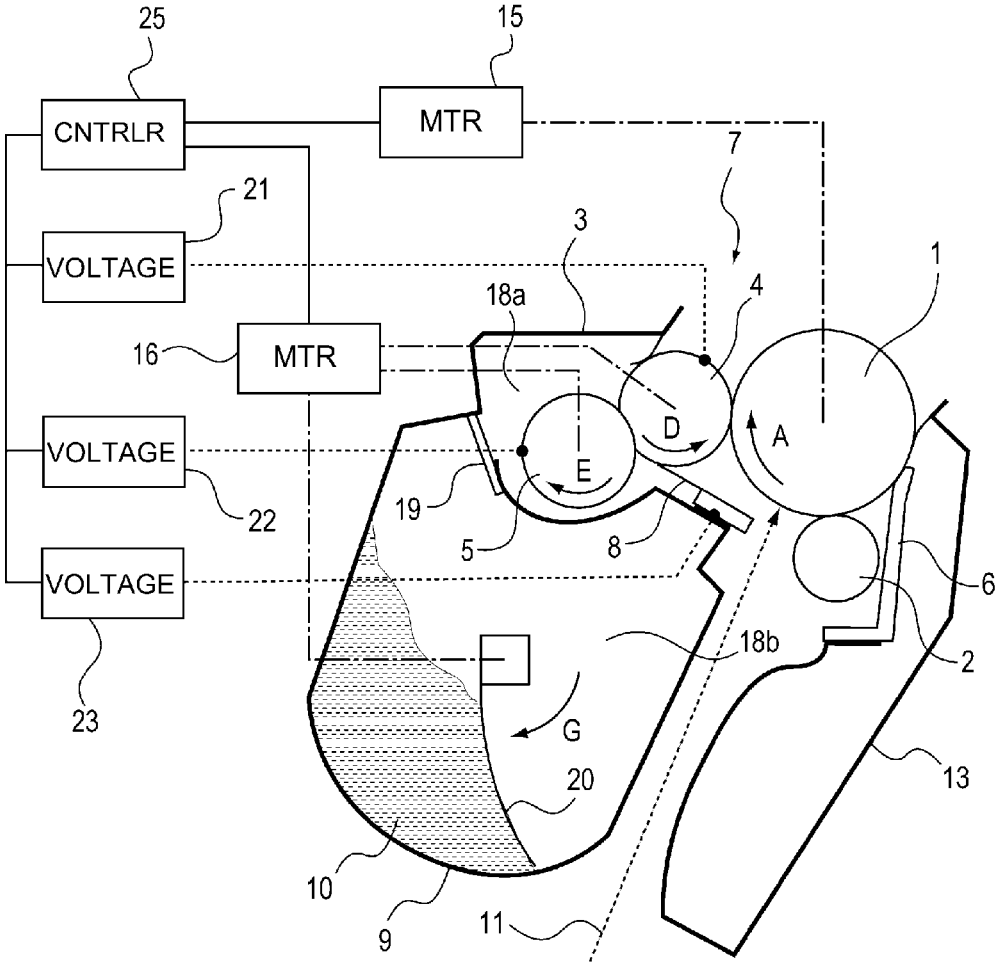
FIG. 2 is a combination of a sectional view of a process cartridge and a system for controlling the process cartridge. It is for describing the structure of the cartridge and control system.

Referring to FIG. 2, the photosensitive drum 1 is rotationally driven by a motor 15 which is a mechanical force source which is controlled by a controller 25 which is a controlling means. There is disposed a scanner unit 30, which is an image exposing means, in the adjacencies of the peripheral surface of the photosensitive drum 1. The scanner unit 30 forms an electrostatic latent image by scanning the uniformly charged peripheral surface of the photosensitive drum 1 with a beam 11 of laser light which it emits while modulating the beam 11 according to the image information. As the toner 10 is supplied to the electrostatic latent image formed on the peripheral surface of the photosensitive drum 1 by the developing device 3 which is a developing means, a toner image is formed on the peripheral surface of the photosensitive drum 1.

There is provided an intermediary transfer belt 31, which is disposed so that it opposes photosensitive drums 1Y, 1M, 1C and 1K which correspond to yellow Y, magenta M, cyan C and black K colors, respectively. The intermediary transfer belt 31 is structured so that it functions as an intermediary member for transferring the toner image on the photosensitive drum 1 onto a sheet 12 of recording medium. The intermediary transfer belt 31 is suspended by a driver roller 31*a* and an idler roller 3l*b*. It is an endless belt, and it circularly moves (rotates) in the counterclockwise direction indicated by an arrow mark B in FIG. 1, while remaining in contact with the peripheral surface of all the photosensitive drums 1.

There are disposed four primary transfer rollers 32Y, 32M, 32C and 32K, which are primary transferring means, on the inward side of the loop which the intermediary transfer belt 31 forms. The primary transfer rollers 32Y, 32M, 32C and 32K oppose the peripheral surface of the corresponding photosensitive drums 1Y, 1M, 1C and 1K, respectively. To each of the primary transfer rollers 32, a primary transfer bias voltage, the polarity of which is opposite to the polarity to which the toner 10 is normally chargeable, is applied from an unshown primary transfer bias power source. Therefore, the toner image on the peripheral surface of the photosensitive drum 1 is transferred (primary transfer) onto the outward surface of the intermediary transfer belt 31.

There is also disposed a secondary transfer roller 33 which is a secondary transferring means, on the outward side of the loop which the intermediary transfer belt 31 forms. It is positioned so that it opposes the driver roller 31*a*. To the secondary transfer roller 33, a secondary transfer bias voltage is applied from an unshown secondary transfer bias power source. The polarity of the secondary transfer bias voltage is opposite from the polarity to which the toner 10 is normally chargeable. As a result, the toner image on the outward surface of the intermediary transfer belt 31 is transferred (secondary transfer) onto the sheet 12 of recording medium.

In an image forming operation for forming a full-color image, for example, the above-described image formation process is sequentially carried out in the image formation sections 14Y, 14M, 14C and 14K. Thus, yellow Y, magenta M, cyan C and black K toner images are sequentially transferred in layers (primary transfer) onto the outward surface of the intermediary transfer belt 31. Thereafter, the sheet 12 of recording medium is fed into the main assembly of the image forming apparatus 100 by a combination of a sheet feeder roller and a separating means, is conveyed to a pair of registration rollers 24, is corrected in attitude by the registration rollers 24, and then, is conveyed to the secondary transferring section, which is the nip between the secondary transfer roller 33 and intermediary transfer belt 31, in synchronism with the movement of the intermediary transfer belt 31. Then, the four monochromatic toner images, different in color, on the outward surface of the intermediary transfer belt 31 are transferred together (secondary transfer) onto the sheet 12, by the function of the secondary transfer roller 33 which is kept pressed against the intermediary transfer belt 31 with the presence of the sheet 12 between itself and intermediary transfer belt 31.

After the transfer of the toner images onto the sheet 12 of recording medium, the sheet 12 is conveyed to a fixing device 34 as a fixing means. In the fixing device 34, the toner 10 on the sheet 12 is subjected to heat and pressure. Consequently, the toner images become fixed to the sheet 12.

<Process Cartridge>

Next, referring to FIG. 2, the process cartridge 7 which is installable in the main assembly of the image forming apparatus 100 is described about its structure. FIG. 2 is a sectional view of the process cartridge 7 in this embodiment of the present invention. It is for describing the structure of the process cartridge 7. By the way, in this embodiment, the four process cartridges 7 are the same in structure and operation, although they are different in the type (color) of the toner 10 which they store in their developer container 9. The process cartridge 7 has: the photosensitive unit 13 which has the photosensitive drum 1, and the like, and developing device 3 which is a development unit having the development roller 4, and the like.

<Photosensitive Unit>

To the photosensitive unit 13, the photosensitive drum 1 is rotatably attached with the placement of unshown bearings between the photosnsitive unit 13 and photosensitive drum 1. As the photosensitive drum 1 receives driving force from the motor 15, which is a power source for driving the photosensitive drum 1, it is rotationally driven in the direction indicated by an arrow mark A in FIG. 2, by the driving force received from the motor 15.

The photosensitive unit 13 has a charge roller 2 as a charging means, and a cleaning member 6 as a cleaning means, which are disposed in contact with the peripheral surface of the photosensitive drum 1. To the charge roller 2, a charge bias voltage which is sufficient to charge the peripheral surface of the photosensitive drum 1 to a given potential level, is applied from an unshown charge bias power source. In this embodiment, the charge bias voltage is applied to the charge roller 2 so that the peripheral surface of the photosensitive drum 1 is given -550 V of potential.

As the peripheral surface of the photosensitive drum 1, which has just been uniformly charged by the charge roller 2, is scanned by the beam 11 of laser light emitted from the scanner unit 30 while being modulated according to the image information, an electrostatic latent image is formed on the peripheral surface of the photosensitive drum 1. In this embodiment, the intensity of beam 11 of laser light is set to 0.2 $\mu J/cm^2$, so that as the charged peripheral surface of the photosensitive drum 1 is scanned by the beam 11 of laser light, an electrostatic latent image which is 150 V in potential level is formed on the peripheral surface of the photosensitive drum 1.

<Developing Device>

Referring to FIG. 2, the developing device 3 has: the developer container 9 in which the toner 10 is stored; and the development roller 4, as a developer bearing member, which bears the toner 10. It has also a toner supply roller 5, as a developer supplying member, which is disposed in contact with the development roller 4 to supply the development roller 4 with the toner 10. Further, it has a regulation blade 8, as a developer regulating member, which is for forming a thin layer of the toner 10 by regulating in thickness the layer of toner 10 on the peripheral surface of the development roller 4 (developer bearing member), and the like.

The developing device 3 has a development chamber 18*a* and a toner storage chamber 18*b*. In this embodiment, the toner storage chamber 18*b* is on the underside of the development chamber 18*a*. In other words, in this embodiment, the developing device 3 is structured so that it takes a substantial length of time to convey the toner 10 in the toner storage chamber 18*b* to the development chamber 18*a*, and supply the peripheral surface of the development roller 4 with the toner 10. In this embodiment, the normal polarity to which the toner 10 is charged is negative. However, it is not mandatory that the normal polarity to which the toner 10 is charged is negative.

When the developing device 3 is fresh, there is stored a preset amount of toner 10, as developer, in the toner storage chamber 18*b*, and there is no toner 10 in the development chamber 18*a*. In this embodiment, when the developing device 3 is fresh, it has a toner seal 19 in the developer container 9. The toner seal 19 is fixed to the developer container 9 with the use of an unshown adhering means to keep the developer container 9 partitioned from the development chamber 18*a*. The toner seal 19 is not removed when the developing device 3 is shipped out of a factory.

The toner seal 19 prevents the toner 10 leaking out of the developing device 3 through the gap between the edge of the opening of the development chamber 18*a* and the development roller 4 during the distribution of the developing device 3, that is, during the period in which the fresh developing device 3 is shipped out of a factory, and is delivered to a user. In this embodiment, as the fresh process cartridge 7 is installed into the image forming apparatus 100, the toner seal 19 is peeled away by an unshown toner seal peeling means. The unshown toner seal peeling means is driven by the same driving force as that which rotationally drives the development roller 4, the toner supply roller 5, a toner conveying member 20, and the like, of the developing device 3. However, the process cartridge 7 may be structured so that the toner seal 19 is to be peeled away by a user.

There is provided the toner conveying member 20 for conveying the toner 10 to the development chamber 18*a*, in the toner storage chamber 18*b*. The toner conveying member 20 is rotationally driven in the direction indicated by an arrow mark G by a motor 16, as a driving force source, which is controlled by the controller 25. Thus, the toner conveying member 20 scoops up the toner 10 in the toner storage chamber 18*b*, which is on the bottom side in FIG. 2, and delivers the scooped toner 10 upward into the development chamber 18*a*.

Compared to the amount by which the toner 10 is delivered to the development chamber 18*a* of a developing device structured so that the development chamber 18*a* is disposed under or horizontally next to the toner storage chamber 18*b*, the amount by which the toner 10 is delivered to the development chamber 18*a* of the developing device 3 in this embodiment is rather small. In the case of the developing device 3 in this embodiment, therefore, the development roller 4, toner supply roller 5, toner conveying member 20, and the like, of the developing device 3 have to be driven a substantial length of time to peel the toner seal 19 and fill the development chamber 18*a* with the toner 10 to make it possible for the image forming apparatus 100 to form images.

In the development chamber 18*a*, the development roller 4, as the developer bearing member, which is in contact with the peripheral surface of the photosensitive drum 1, and is rotated in the direction indicated by an arrow mark D in FIG. 2, by the driving force it receives from the motor 16, as a driving force source, which is under the control of the controller 25, is disposed. In this embodiment, the development roller 4 and photosensitive drum 1 are rotated in such directions that their peripheral surface moves in the same direction, in the area of contact between the development roller 4 and photosensitive drum 1.

Further, in the development chamber 18*a*, there is disposed the toner supply roller 5 which supplies the development roller 4 with the toner 10 conveyed to the development chamber 18*a* from the toner storage chamber 18*b*. Moreover, in the development chamber 18*a*, there is disposed the regulation blade 8, as a developer regulating member, which regulates in the amount per unit area, the toner 10 on the peripheral surface of the development roller 4, to which the toner 10 was delivered by the toner supply roller 5, and also, gives electrical charge to the toner 10.

The development roller 4 and toner supply roller 5 rotate in the directions D and E, respectively, by receiving rotational driving force from the motor 16, as a driving force source, which is under the control of the controller 25. In this embodiment, the toner supply roller 5 is disposed so that its peripheral surface remains in contact with the peripheral surface of the development roller 4. The amount of hypothetical intrusion of the toner supply roller 5 into the peripheral surface of the development roller 4 is 1.0 mm. The speeds with which the development roller 4 and toner supply roller 5 are rotationally driven are 100 rpm (revolutions per minute) and 200 rpm, respectively. Further, the development roller 4 and toner supply roller 5 are rotated in such directions that the peripheral surface of the development roller 4 and that of the toner supply roller 5 move in the same direction, in the area of contact between the two rollers 4 and 5.

After the development roller 4 is supplied with the toner 10 by the toner supply roller 5, the toner 10 on the development roller 4 is made to enter the area of contact between the regulation blade 8 and development roller 4 by the rotation of the development roller 4 in the direction indicated by the arrow mark D. Then, in the area of contact between the regulation blade 8 and development roller 4, the toner 10 is given triboelectrical charge by the friction between the peripheral surface of the development roller 4 and the regulation blade 8, while the layer of the toner 10 on the peripheral surface of the development roller 4 is regulated in thickness. After being regulated in thickness, the layer of the toner 10 on the peripheral surface of the development roller 4 is conveyed by the rotation of the development roller 4 to the area of contact between the peripheral surface of the development roller 4 and that of the photosensitive drum 1, in which the electrostatic latent image on the peripheral surface of the development roller 4 is developed into a visible image, that is, an image formed of the toner 10 (which hereafter will be referred to simply as toner image).

Referring to FIG. 2, to the electrically conductive supporting members of the development roller 4, toner supply roller 5, and regulation blade 8, preset voltages, which are different in properties, are applied by voltage applying sections 21-23, as voltage applying means (voltage applying devices), with which the image forming apparatus 100 is provided, through unshown electrically conductive contacts. The voltage applying section 21 which is in connection to the development roller 4, and the voltage applying section 23 which is in connection to the regulation blade 8, are structured so that they can be varied in the voltage they apply to the development roller 4 and regulation blade 8, respectively. Further, the voltage applying section 22 which is in connection to the toner supply roller 5 is structured so that the voltage it applies to the toner supply roller 5 can be made different from the voltage applied to the development roller 4 from the voltage applying section 21.

Next, referring to FIG. 2, the development roller 4, toner supply roller 5, and regulation blade 8 are described about their structure. The development roller 4 is 15 mm in external diameter. It is made up of an electrically conductive metallic core which is 6 mm in external diameter, a silicone rubber layer, as substrative layer, which covers the peripheral surface of the metallic core, and a urethane rubber layer, as the surface layer, which covers the outward surface of the silicone rubber layer. The volume resistivity of the development roller 4 is in a range of $1\times10^4\Omega$-$1\times10^{12}\Omega$.

As for the toner supply roller 5, it is 15 mm in external diameter. It is an electrically conductive and elastic sponge roller. It is made up of an electrically conductive metallic core which is 6 mm in external diameter, and a foamed layer formed on the peripheral surface of the metallic core. Its volume resistivity is in a range of $1\times10^4\Omega$-$1\times10^8\Omega$.

The regulation blade 8 is a piece of metallic plate made of stainless steel (SUS), which is 0.1 mm in thickness. It is disposed in contact with the development roller 4 in such a manner that its free edge (regulating edge) is on the upstream side of its base portion, in terms of the rotational direction of the development roller 4 indicated by the arrow mark D in FIG. 2. As the regulation blade 8, it is possible to use a blade made of an electrically conductive supporting member, such as a piece of metallic plate made of stainless steel (SUS), and a layer of polyamide resin, which was made electrically conductive and is laminated to the supporting member. Further, the regulating end of the regulation blade 8 may be given curvature.

<Bias Voltages Applied During Normal Image Forming Operation>

Next, the bias voltages to be applied to the development roller 4, toner supply roller 5, and regulation blade 8 during the normal image forming operation are described. The bias voltage to be applied to the toner supply roller 5 is −400 V. The bias voltage to be applied to the development roller 4 is also −400 V. Thus, the amount of difference in terms of potential level between the toner supply roller 5 and development roller 4 is 0 V.

The bias voltage to be applied to the regulation blade 8 is −500 V. Thus, the difference between the regulation blade 8 and development roller 4 in terms of potential level is −100 V. This difference in potential level works in the direction to move the toner 10 from the regulation blade 8 to the development roller 4. In comparison, the potential level (pre-exposure level Vd) of the peripheral surface of the photosensitive drum 1 is −550 V as described above. Thus, the amount of difference in terms of potential level between the development roller 4 and the peripheral surface of the photosensitive drum 1 is −150 V.

<Coating Agent>

Figure 3:
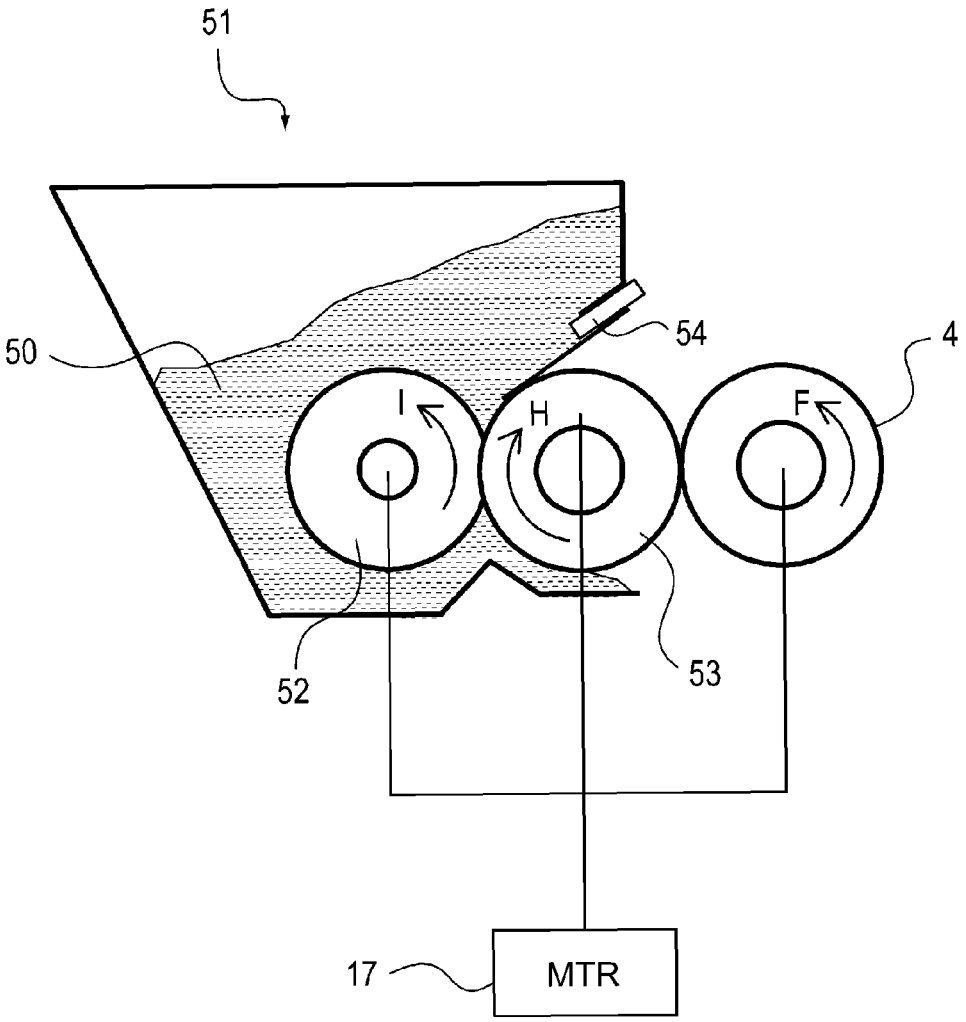
FIG. 3 is a sectional view of a coating device for coating a developer bearing member with a coating agent, and is for describing the structure of the device.

Next, referring to FIG. 3, a coating agent 50 on the peripheral surface of the development roller 4 is described. It is applied to the peripheral surface of the development roller 4 with the use of a coating agent applying method (which is described later), when the process cartridge 7 is shipped out of a factory. In this embodiment, silicone resin particles (Tospearl 120 (commercial name): product of GE-Toshiba Silicone Co., Ltd.) which are 2μm in average diameter are used as the coating agent 50. Tospearl 120 (commercial name) is the same in characteristic as the toner 10 in that it becomes negatively charged like the toner 10. As the coating agent 50, it is possible to use other particled substances than silicone resin particles. That is, this embodiment is not intended to limit the present invention in terms of the coating agent for the development roller 4. That is, any particled substance can be used as the coating agent 50, as long as it becomes negatively charged like the coating agent 50. For example, the toner 10 itself can be used as the coating agent 50.

That is, in a process cartridge manufacturing process, the development roller 4 is to be coated in advance with toner which is to be used as the coating agent 50, that is, toner which is different from the toner 10 stored in the toner storage chamber 18*b*. By the way, in a case where toner is used as the coating agent 50, toner which is different in color from the toner 10 in the toner storage chamber 18*b*, may be used. That is, in this embodiment, there are contained the yellow Y, magenta M, cyan C and black K toners in the process cartridges 7Y, 7M, 7C and 7K, respectively. However, the toners to be applied to the development rollers 4 of the process cartridges 7 may be the same in color.

For example, yellow Y toner can be used as the coating agent 50 for all the process cartridges 7Y, 7M, 7C and 7K. In such a case, the toner to be applied to the development roller 4 is different from the toners 10 to be stored in the toner storage chamber 18*b* of process cartridges 7M, 7C and 7K. On the other hand, in the case of the process cartridge 7Y, the toner to be coated on the development roller 4 is the same as the toner 10 to be stored in the toner storage chamber 18*b*.

The following are examples of particled substances, which can be used as the coating agent 50, in addition to the toner 10.

As for particled resinous substance, silicone resin, polyalkylene resin such as polyethylene, polypropylene, and the like, and fluorine resin such as polyfluorovinylidene, polytetrafluoroethylene, can be used. Further, polyethylene resin such as polyethyleneterephthalate, polybutyleneterephthalate, and the like, styrene resin such as polystyrene, etc., acrylic resin such as polymethyl-methacrylate, etc., styrene-acrylic resin such as copolymer of styrene-methyl acrylate, and the like, can be used. Moreover, phenol resin, urea resin, melamine resin, epoxy resin, urethane resin, polyamide resin, and the like, can be also be used.

Further, as for particled fatty acid, such long chain fatty acid as undecyl acid, myristic acid, lauric acid, undecanoic acid, palmitic acid, pentadecanoic acid, stearic acid, heptadecanoic acid, arachidic acid, montanic acid, olein acid, linoleic acid, arachidonic acid, and the like, can be used. In addition, as for metallic salts, salts of such metals as zinc, iron, magnesium, aluminum, calcium, sodium, lithium, and the like, can be used.

Moreover, as materials for particled inorganic substances, such inorganic substances as inorganic metallic oxides, inorganic nitride, inorganic carbonate, sulfate, or metallic salt carbonate, and the like, can be used. More concretely, such oxides as silicon oxide, titanium oxide, strontium titanate, aluminum oxide (alumina), and the like, such nitride as boron nitride, silicon nitride, and the like, such carbonate as silicon carbonate, titanium carbonate, boron carbonate, and the like, such boride as tungsten boride, and the like, can be listed.

These particled substances are treated on their surface with silane coupler, titanium coupler, silicone oil, high polymer of fatty acid, or their metallic salts, to make them hydrophobic, or to control them in property in terms of triboelectric charge.

The information regarding the property of the particled substances in terms of triboelectric charge, can be obtained by finding out whether they become positively charged relative to a substance against which they rub, or negatively.

Generally speaking, however, silicone resin, fluorine resin, and polyester resin can be listed as a substance which is likely to become negatively charged. On the other hand, phenol resin, melamine resin, epoxy resin, urethane resin, and polyamide resin can be listed as a substance which is likely to become positively charged.

<Method for Applying Coating Agent>

Next, referring to FIG. 3, the method for applying coating agent 50 is described. In this embodiment, a method for coating the peripheral surface of the development roller 4 with the coating agent 50 is used as the method for placing the coating agent 50 between the development roller 4 and a component which is in contact with the development roller 4. Here, this method is described with reference to FIG. 3. However, this embodiment is not intended to limit the present invention in scope in terms of the coating agent applying method, that is, the method for directly applying the coating agent 50 to the peripheral surface of the development roller 4. For example, the coating agent applying method may be such that the coating agent 50 is applied to the toner supply roller 5 to transfer the coating agent 50 to the development roller 4 from the toner supply roller 5 which is in contact with the development roller 4.

FIG. 3 is a sectional view of a coating agent applying device 51 for applying the coating agent 50 to the peripheral surface of the development roller 4. It shows the structure of the coating agent applying device 51. The coating agent applying device 51 is provided with an application roller 53 for applying the coating agent 50 to the development roller 4, a supply roller 52 for supplying the application roller 53 with the coating agent 50, and a regulation member 54 for regulating the coating agent 50 on the application roller 53 in the amount per unit area. There is the coating agent 50 in the coating agent applying device 51. The coating agent applying device 51 is structured so that the development roller 4 can be rotatably attached to the coating agent applying device 51 with the placement of unshown development roller mounting members between the development roller 4 and the frame of the coating agent applying device 51. The development roller 4, application roller 53, and supply roller 52 rotate in the directions F, H and I, respectively, by receiving rotational force from a motor 17 as a driving force source.

The supply roller 52 for supplying the application roller 53 with the coating agent 50 in the coating agent applying device 51 is an elastic sponge roller, which is similar to the toner supply roller 5 shown in FIG. 2. That is, it is made of an electrically conductive metallic core, and a layer of foamed substance which covers the peripheral surface of the metallic core. It is disposed in such a manner that its peripheral surface contacts the peripheral surface of the application roller 53, and forms a nip having a preset size. As the supply roller 52 is rotated in the direction indicated by the arrow mark I in FIG. 3, it supplies the application roller 53 with the coating agent 50 in the coating agent applying device 51.

After the coating agent 50 is supplied to the application roller 53 by the supply roller 52, the coating agent 50 on the application roller 53 is made to enter the area of contact between the application roller 53 and regulation member 54 by the rotation of the application roller 53 in the direction indicated by the arrow mark H in FIG. 3. Then, the coating agent 50 is charged, that is, given triboelectric charge, by the friction between itself and the peripheral surface of the application roller 53, and the friction between itself and the regulation member 54, while the layer of the coating agent 50 is regulated in thickness. Then, the layer of the coating agent 50 which has a preset thickness, is conveyed to the area of contact between the application roller 53 and development roller 4, by the rotation of the application roller 53 in the direction indicated by the arrow mark H in FIG. 3.

To the application roller 53, an application bias voltage which is sufficient to transfer the coating agent 50 onto the development roller 4 is applied from an unshown application bias power source. Thus, the coating agent 50 on the peripheral surface of the application roller 53 transfers onto the development roller 4 in a manner to uniformly cover the peripheral surface of the development roller 4 in terms of the lengthwise direction of the development roller 4.

The coating agent 50 on the development roller 4 functions to lubricate between the development roller 4 and toner supply roller 5 of the developing device 3. Thus, it is possible to reduce the friction which occurs between the development roller 4 and toner supply roller 5, and the friction which occurs between the development roller 4 and regulation blade 8, as the two rollers 4 and 5 are rotationally driven. Therefore, it is possible to reduce the amount of rotational torque necessary to rotationally drive the developing device 3.

<Vertical Streaks>

It sometimes occurred immediately after the fresh developing device 3 began to be used for the first time by an image forming apparatus such as the image forming apparatus 100 that the image forming apparatus outputted an image having vertical streaks. In a case where the amount of the coating agent 50 on the development roller 4 is small, the amount by which the coating agent 50 enters the area of contact between the development roller 4 and regulation blade 8 immediately after the fresh developing device 3 begins to be driven is also small. Therefore, there occurs a substantial number of small gaps, that is, areas which are not filled with the coating agent 50, between the peripheral surface of the development roller 4 and regulation blade 8, in terms of the lengthwise direction of the development roller 4 (regulation blade 8). Further, it takes a substantial length of time for the peripheral surface of the development roller 4 to be supplied with the toner 10 after the development roller 4, toner supply roller 5, and toner conveying member 20 of the fresh developing device 3 begin to be rotationally driven.

Therefore, it takes a substantial length of time for the toner capturing area, which is between the regulating edge of the regulation blade 8 and development roller 4, to be sufficiently filled with the toner 10. Therefore, the development roller 4, toner supply roller 5, and toner conveying member 20 of the developing device 3 end up rotating for a relatively long period of time with the presence of the substantial number of gaps between the regulating area. During this period, foreign substances such as dust, paper burrs, and the like, in the developing device 3, which had adhered to the adjacencies of the regulation blade 8, enter the above-described gaps in the toner capturing area, and get stuck in the gaps, causing thereby the image forming apparatus 100 to output images having vertical streaks.

As the means for minimizing the frequency with which the image forming apparatus 100 outputs images having vertical streaks, it is effective to carry out the following method from when the development roller 4, toner supply roller 5, and toner conveying member 20 of the fresh developing device 3 begin to be rotated to when the peripheral surface of the development roller 4 is provided with a preset amount of the toner 10. That is, it is effective to keep the coating agent 50 collected in the toner capturing area, that is, the immediate adjacencies of the regulating edge portion of the regulation blade 8. With the presence of a relatively large amount of coating agent 50 along the regulating edge of the regulation blade 8, it is possible to prevent the foreign substances such as dust, paper burrs, and the like, from entering, and getting stuck, in the abovementioned gaps in the toner capturing area.

Here, to supply the peripheral surface of the development roller 4 with a preset amount of toner 10 means to supply the development chamber 18*a* with the toner 10 by such an amount that is sufficient to fill the interface between the regulating edge of the regulation blade 8 and development roller 4 with the toner 10 as the development roller 4, toner supply roller 5, and toner conveying member 20 of the developing device 3 are rotationally driven, even when the aforementioned various biases to be applied for image formation are the normal ones.

As long as the toner capturing area, which is in the adjacencies of the regulating edge of the regulation blade 8, is supplied with the toner 10 by an amount which is enough to fill up the toner capturing area, it is possible to prevent foreign substances such as dust, paper burrs, and the like, from entering the adjacencies. Therefore, the settings for the various bias voltages may be the same as those for the normal image formation.

In this embodiment, the control sequence for collecting and keeping the coating agent 50 in the toner capturing area, which is in the immediate adjacencies of the regulating edge of the regulation blade 8 is as follows. This control sequence is carried out as the initialization control (initialization sequence) which is to be carried out during the period between when the fresh developing device 3 is installed in the main assembly of the image forming apparatus 100 and when the image forming apparatus 100 becomes ready for image formation, that is, it is put on standby.

<Control of Initializing Operation>

Figure 4:
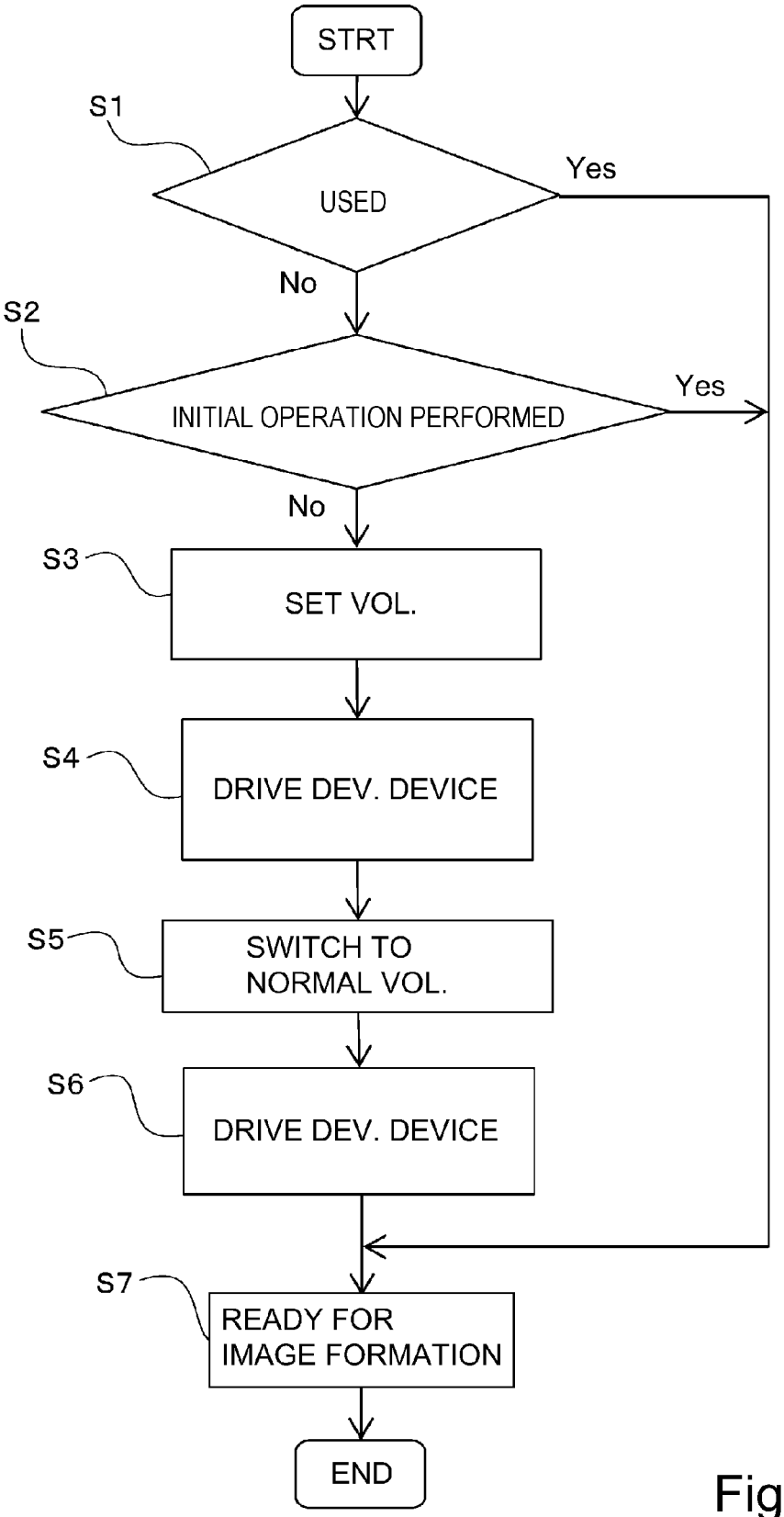
FIG. 4 is a flowchart of an initializing operation.
Figure 5:
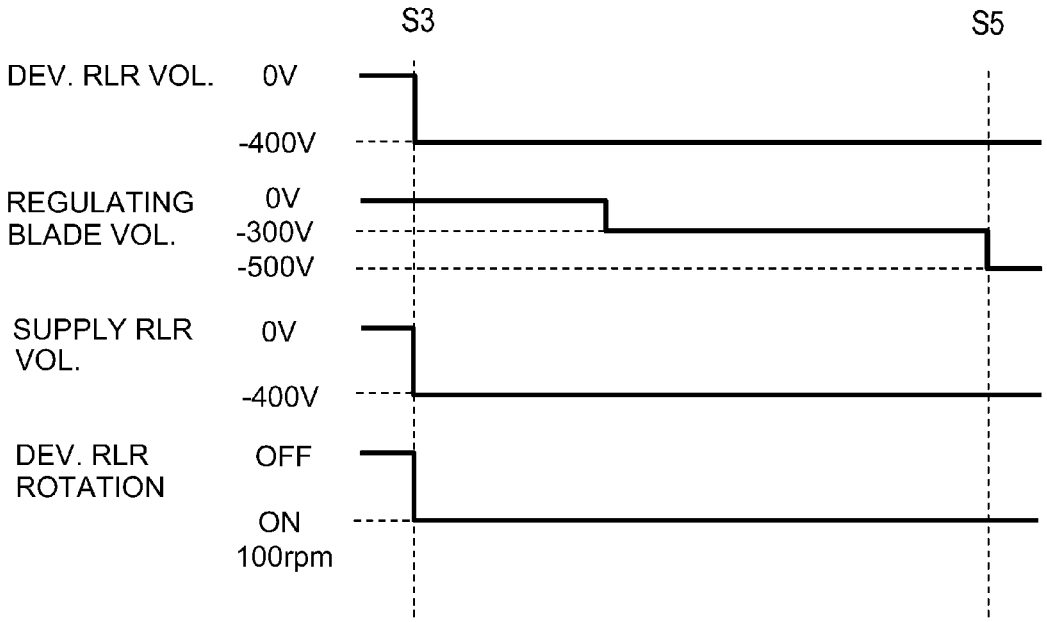
FIGS. 5(*a*) and (*b*) are timing charts which show a bias application timing, and a timing with which the developer bearing member is rotationally driven, in first and second embodiments of the present invention.
Figure 5:
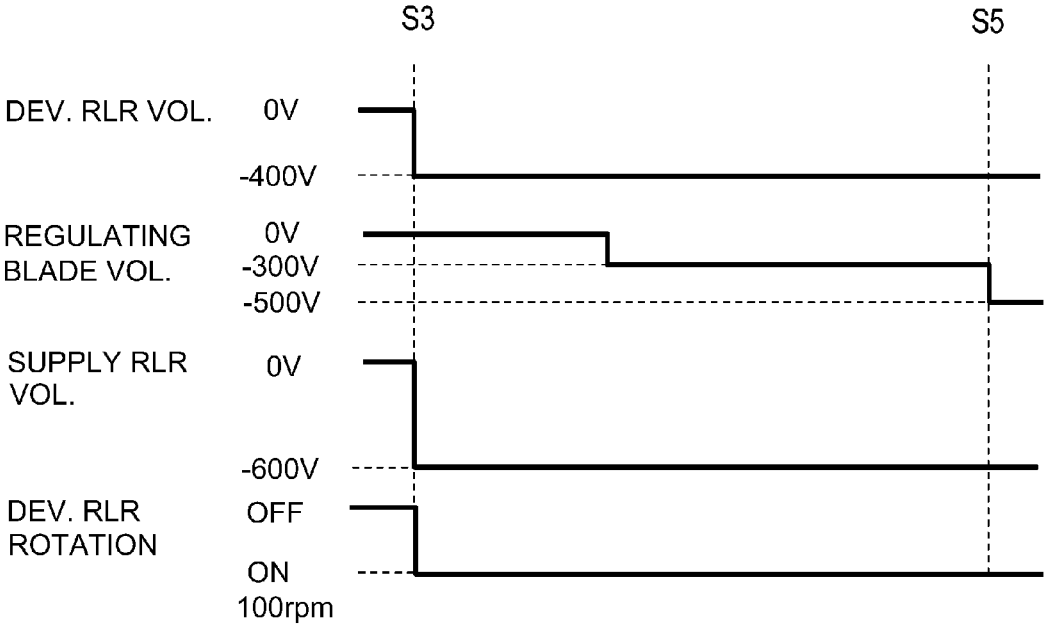
Figure 6:
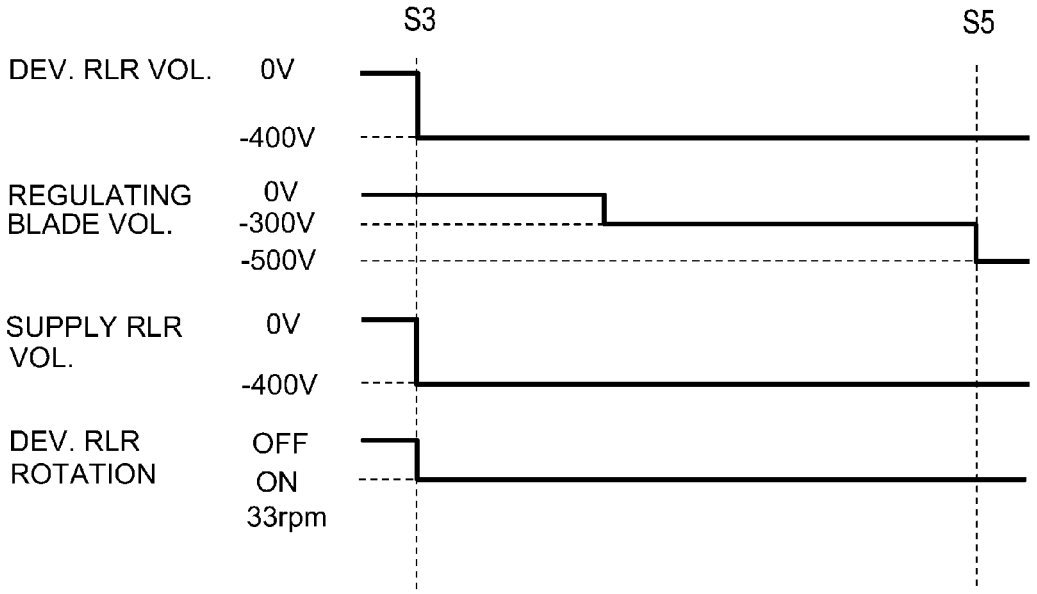
FIGS. 6(*a*) and (*b*) are timing charts which show a bias voltage application timing, and a timing with which the developer bearing member of the developing device in a third embodiment, and the developer bearing member of a comparative developing device are rotationally driven.
Figure 6:
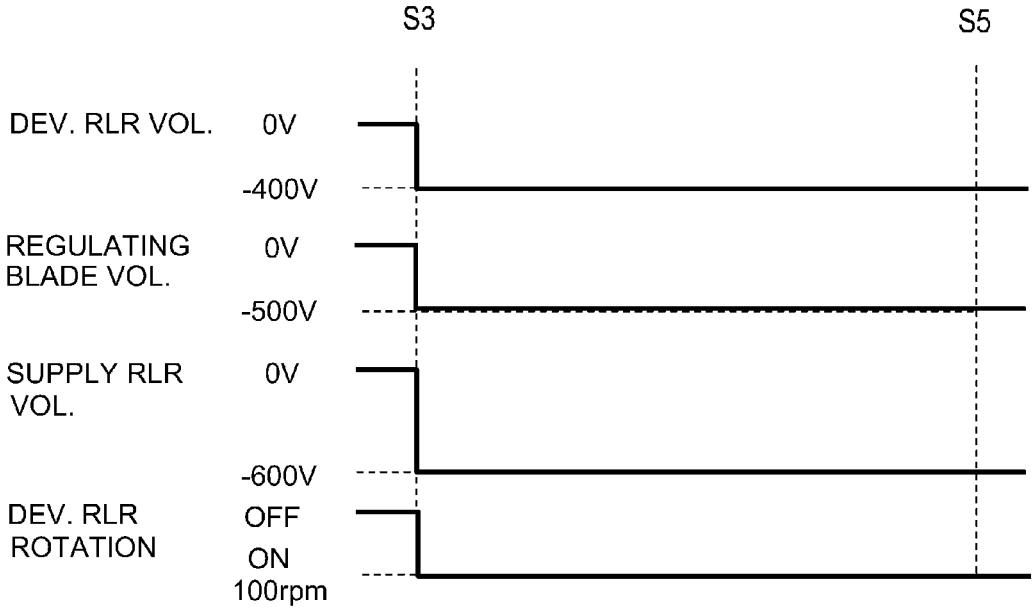

Next, referring to FIGS. 4-6(*b*), the control of the initializing operation is described. In the case of the image forming apparatus 100 in this embodiment, the first operation to be carried out after the installation of the fresh developing device 3 into the main assembly of the image forming apparatus 100 is the initializing operation in which the development roller 4, toner supply roller 5, and toner conveying member 20 of the development roller 4 are rotationally driven.

In Step S1 in FIG. 4, the controller 25 which is the controlling means with which the main assembly of the image forming apparatus 100 is provided decides whether the developing device 3 has ever been used (is fresh) or not. Whether or not the developing device 3 has ever been used (is fresh) is detected by one of known detecting means. If the developing device 3 has never been used, the controller 25 proceeds to Step S2. If the developing device 3 has been used, the controller 25 proceeds to Step S7, in which it readies the image forming apparatus 100 for image formation, and then, keeps the image forming apparatus 100 on standby. In Step S2, the controller 25 decides whether or not the initializing operation has been carried out. If the developing device 3 has been initialized, the controller 25 proceeds to Step S7, in which it readies the image forming apparatus 100 for image formation and keeps the image forming apparatus 100 on standby. If the initializing operation has not been carried out, the controller 25 proceeds to Step S3.

In Step S3, the controller 25 sets the voltage application sections 21-23, for the application of the initialization bias voltages. Then, in Step S4, the controller 25 drives the motor 16 to rotationally drive the toner conveying member 20, toner supply roller 5, and development roller 4 of the developing device 3 until the development chamber 18*a* is provided with a preset amount of toner 10.

Next, in Step S5, the controller 25 switches the voltage application sections 21-23 in bias voltage from the initialization bias voltage to the image formation bias voltage. Next, in Step S6, the controller 25 drives the motor 16 to rotationally drive the toner conveying member 20, toner supply roller 5, and development roller 4 of the developing device 3 until the development chamber 18*a* is provided with the preset amount of toner 10. Thereafter, it proceeds to Step S7, in which it readies the image forming apparatus 100 for image formation, and keeps the image forming apparatus 100 on standby.

In this embodiment, in Step S3, the bias voltages are set so that it is possible to collect and keep the coating agent 50 in the toner capturing area, which is in the immediate adjacencies of the regulating edge of the regulation blade 8. Then, in Step S4, the developer conveying member 20, toner supply roller 5, and development roller 4 of the developing device 3 begin to be rotationally driven, and are continuously driven until the toner 10 in the toner storage chamber 18*b* is delivered to the development chamber 18*a* by the preset amount.

The length of time the developing device 3 needs to be rotationally driven is affected by the structure of the developing device 3. Thus, it is desired to be set to a proper value. In this embodiment, the length of time necessary for the development chamber 18*a* to be supplied with the preset amount of toner 10 was long enough for the development roller 4 to be rotated 100 times, even in consideration of how the developing device 3 was stored, and the like factors.

In the above-described Step S5, the controller 25 changes the voltage application sections 21-23 in bias voltage from those for initialization to those for the normal image formation. Then, in Step S6, it rotationally drives the developing device 3 until the development chamber 18*a* is supplied with a sufficient amount of toner 10. The sufficient amount by which the development chamber 18*a* is to be supplied with toner 10 is such an amount that makes it possible for the image forming apparatus 100 to output high density images such as solid images which do not suffer from defects.

In the above-described Step S5, the controller 25 changes the voltage application sections 21-23 in bias voltage from those for the initialization to those for the normal image formation, for the following reason. That is, if the developing device 3 is rotationally driven for a long time while the bias voltages to be applied by the voltage application sections 21-23 are left the same as those for the initialization set in Step S6, the toner 10 solidly adheres to the regulating edge of the regulation blade 8. Further, the length of time the developing device 3 is to be rotationally driven in Step S6 is affected by the structure of the developing device 3. Thus, it is desired to be appropriately set. In this embodiment, the total length of time the developing device 3 is to be rotationally driven for the initialization is equivalent to the length of time necessary to rotate the development roller 4 roughly 500 times.

FIGS. 5(*a*) and (*b*) and 6(*a*) and (*b*) show how the controller 25 controls the bias voltages to be applied to the development roller 4, regulation blade 8, and toner supply roller 5 with the use of the voltage application sections 21-23, respectively, in Steps S3 and S5 in FIG. 4. More concretely, FIGS. 5(*a*) and (*b*) and 6(*a*) and (*b*) are timing charts which show the timings with which the voltage application sections 21-23 are changed in bias voltage in the first to third embodiments, and in the case of the comparative developing device 3. They show the rotational speed (rpm) of the developing device 3 along with the timings.

Further, in order to verify the effects of this embodiment, six development rollers 4 which were different in the amount (5 mg, 10 mg, 30 mg, 50 mg, 70 mg and 90 mg, as shown in FIG. 7) by which they were coated with the coating agent 50 before they are shipped out of a factory were prepared. Then, these development rollers 4 were subjected to experiments for comparing them in terms of their effects upon the severity of the vertical streaks.

The reason why the six development rollers 4 which were different in the amount by which their peripheral surface was coated with the coating agent 50 were tested in the experiments is as follows. If it is possible to reduce the amount by which the development roller 4 is to be coated with the coating agent 50 when the developing device 3 is shipped out of a factory, it becomes unnecessary to strictly control the amount by which the development roller 4 is to be coated. Therefore, it has an excellent effect that it reduces the cost for manufacturing the developing device 3. In addition, if it is possible to reduce the amount by which the development roller 4 is to be coated with the coating agent 50, it is possible to reduce the risk that the coating agent 50 scatters during the process of applying the coating agent 50, on the developing device manufacture line, and also, while the developing device 3 is transported after its shipment out of a factory.

Then, the images formed with the use of the six development rollers 4 which were different in the amount by which their peripheral surface was coated with the coating agent 50 before they were shipped out of a factory were examined regarding the presence or absence of the vertical streaks, as shown in FIG. 7. With these experiments, it was possible to clearly verify the effects of this embodiment. More concretely, in the case of the development roller 4, which was 0 mg in the amount of the coating agent 50 on its peripheral surface, the developing device 3 was higher in the amount of torque that was required to rotate the development roller 4. Thus, there occurred such a problem that the regulation blade 8 breaks. In comparison, in the case of the development roller 4, which was 100 mm in the amount of the coating agent 50 on its peripheral surface, there occurred such problems that the coating agent 50 scatters while the coating agent 50 was applied on the manufacture line, and while the developing device 3 was transported after it was shipped out of a factory.

By the way, in order to make the developing devices in the first to third embodiments, and the comparative developing device, the same in the amount of their internal dust, paper burrs, and the like, they were made the same in the condition under which they were assembled. The experiments were carried out in an environment which was 23° C. in temperature, and 50% in humidity. In the case of each of the development rollers 4 which are different in the amount of the coating agent 50, the fresh process cartridge 7 was installed in the main assembly of the image forming apparatus 100, and the initializing operation was carried out. Then, immediately after the initializing operation was completed, such a solid black image that is capable of covering a sheet of recording paper from one end of the sheet to the other (area across which image is formable) in terms of the lengthwise direction of the photosensitive drum 1), that is, such a solid image that is highest in print ratio, was printed.

Referring to FIG. 7, the severity of the vertical streaks was evaluated in three levels of severity. "G" stands for a case where there was no visible vertical streak, and "F⇆ stands for a case where vertical streaks were faintly visible. "NG" stands for a case where vertical streaks were unacceptably severe.

Next, referring to FIGS. 5(*a*) to 7, the results of the experiments in which the developing device 3 in the first to third embodiments of the present invention, and the comparative developing device 3, were tested are described.

<Comparative Developing Device>

In the case of the comparative developing device 3, which corresponds to FIG. 6(*b*) , and FIG. 7, such a bias voltage that works in the direction to cause the coating agent 50 to move from the regulation blade 8 to the development roller 4 was applied between the development roller 4 and regulation blade 8 during the initializing operation. In the case of the comparative developing device 3 which corresponds to FIG. 6(*b*), −400 V was applied to the development roller 4, and −500 V was applied to the regulation blade 8. These bias voltages were the same in properties as those applied for the normal image formation. Referring to FIG. 7, in the case of the comparative developing device 3, vertical streaks occurred regardless of the amount by which the peripheral surface of the development roller 4 was coated with the coating agent 50 (whether amount was 5 mg, 10 mg, 30 mg, 70 mg or 90 mg).

In the case of the developing device 3 in the first embodiment, which corresponds to FIG. 5(*a*), and FIG. 7, such a bias voltage that works in the direction to cause the coating agent 50 to move from the development roller 4 to the regulation blade 8 is applied between the development roller 4 and regulation blade 8 during the initializing operation. In the case of the developing device 3 in the first embodiment, which corresponds to the FIG. 5(*a*), −400 V was applied to the development roller 4, and −300 V was applied to the regulation blade 8.

In the initializing operation, such bias voltages (voltages for initializing operation) that are different from those applied to the development roller 4 and regulation blade 8 by the voltage application sections 21 and 23 during a normal image forming operation are applied to the development roller 4 and regulation blade 8 during the period from when the development roller 4 begins to be rotationally driven until the peripheral surface of the development roller 4 is supplied with the preset amount of toner 10. These bias voltages (voltages for initializing operation) which are different from those applied during a normal image forming operation were the same as those to be applied to cause the coating agent 50 which was applied to the peripheral surface of the development roller 4 before the developing device 3 was shipped out of a factory, to move toward the regulation blade 8.

To describe in greater detail, during a normal image forming operation, it is necessary to cause the negatively charged toner 10 to move from the regulation blade 8 to the development roller 4. During a normal image forming operation, therefore, such bias voltage that puts the potential level of the regulation blade 8 on the negative side (toner potential side) of that of the development roller 4 is applied to the regulation blade 8. That is, during a normal image forming operation, −500 V is applied to the regulation blade 8, and −400 V is applied to the development roller 4. Thus, the toner 10 which is negative in polarity is pressured to move from the regulation blade 8 to the development roller 4.

On the other hand, during an initializing operation, in order to keep the coating agent 50 (silicone resin particles) which became negatively charged, attracted to the regulation blade 8, such bias (voltage) that is on the positive side of the potential level of the development roller 4 is applied to the regulation blade 8. That is, during an initializing operation, −300 V is applied to the regulation blade 8, and −400 V (the same as voltage applied during image forming operation) is applied to the development roller 4. Therefore, the negative charged coating agent 50 is pressured to move from the development roller 4 to the regulation blade 8.

That is, the voltage applied to the development roller 4 during a normal image forming operation is the same as the voltage applied to the development roller 4 during an operation in which no image is formed. In comparison, the voltage applied to the regulation blade 8 changes in the polarity relative to the voltage applied to the development roller 4. That is, during an image forming operation, the voltage (−500 V) applied to the regulation blade 8 is on the negative side (the same side as toner 10 and coating agent 50) of the voltage (−400 V) applied to the development roller 4. During an initializing operation, the voltage (−300 V) applied to the regulation blade 8 is on the plus side (opposite side from those of toner 10 and coating agent 50) of the voltage (−400 V) applied to the development roller 4.

In other words, the voltage (−300 V) to be applied to the development roller 4 during an initialization operation is on the plus side (opposite side of polarity of toner 10 and coating agent 50) of the voltage (−500 V) to be applied to the regulation blade 8 during an image forming operation.

By controlling the bias voltages as described above, it is possible to attract the negatively charged coating agent 50 on the peripheral surface of the development roller 4, to the toner catching portion of the regulation blade 8. Therefore, it is possible to collect the coating agent 50 by the catching portion of the regulation blade 8 and keep the collected coating agent 50 attached to the catching portion to prevent gaps from forming between the catching portion of the regulation blade 8 and the peripheral surface of the development roller 4. Therefore, it is possible to prevent foreign substances such as dust, paper burrs, and the like, from entering between the catching portion (regulating edge) of the regulation blade 8, and the peripheral surface of the development roller 4 in order to prevent the occurrence of the vertical streaks. Referring to FIG. 7, according to the results of these experiments, unlike in the case of the comparative developing device 3, in the case of the developing device 3 in this embodiment, as the amount by which the coating agent 50 was applied to the development roller 4 was increased to roughly 30 mg, the occurrences of the vertical streaks began to reduce. Then, as the amount was set in a range of 50 mg-90 mg, the vertical streaks did not occur.

[Embodiment 2]

In the case of the developing device 3 in the second embodiment of the present invention, shown in FIG. 5(*b*), and FIG. 7, in addition to the bias voltage applied during an initializing operation in the first embodiment, such a bias voltage that works in the direction to move the coating agent 50 from the toner supply roller 5 to the development roller 4 is applied between the toner supply roller 5 and development roller 4. In the case of the developing device 3 shown in FIG. 5(*b*), during the initializing operation, −400 V was applied to the development roller 4, and −300 V was applied to the regulation blade 8. Further, −600 V was applied to the toner supply roller 5.

The initializing operation applies to the development roller 4 and toner supply roller 5, such bias voltages that are different from those applied to them during a normal image forming operation, with the use of the voltage application sections 21 and 22, during the period between when the development roller 4 begins to be rotationally driven, to when the peripheral surface of the development roller 4 is supplied with the preset amount of toner 10. These bias voltages which are different from those applied during a normal image forming operation are such voltages that work in the direction to cause the coating agent 50 coated on the peripheral surface of the development roller 4 before the fresh developing device 3 was shipped out of the factory, to move from the toner supply roller 5 to the development roller 4.

To describe in greater detail, the voltage to be applied to the toner supply roller 5 has a value (−600 V) which is on the minus side (the same side as toner 10 and coating agent 50) of the voltage (−400) which is to be applied to the development roller 4 during an initializing operation.

By the way, in this embodiment, the voltage to be applied to the toner supply roller 5 during a normal image forming operation has the same value (−600 V) as the voltage to be applied to the toner supply roller 5 during an initializing operation. However, the value of the voltage to be applied to the toner supply roller 5 during an image forming operation may be switched to the same value (−400 V: FIG. 5(*a*)) as the one in the first embodiment, while keeping the voltage to be applied to the toner supply roller 5 during an initializing operation at −600 V.

By controlling the bias voltages as described above, it is possible to reduce the amount by which the coating agent 50 on the peripheral surface of the development roller 4 is stripped away from the development roller 4 by the toner supply roller 5. Therefore, it becomes possible to increase the amount by which the coating agent 50 collects on the catching portion of the regulation blade 8. Referring to FIG. 7, according to the above-described experiments, as the amount by which the coating agent 50 was applied to the peripheral surface of the development roller 4 was increased to roughly 10 mg, the occurrence of the vertical streaks began to reduce, and the vertical streaks did not occur when the amount of the coating agent 50 on the development roller 4 was in a range of 30 mg-90 mg, which was wider than that in the above-described first embodiment. That is, the second embodiment was better in terms of the effect of blocking foreign substances such as dust, paper burrs, and the like, to prevent the occurrence of vertical streaks, even though the amount by which the coating agent 50 was applied to the peripheral surface of the development roller 4 of the developing device 3 before the developing device 3 was shipped out of a factory was smaller.

[Embodiment 3]

In the case of the developing device 3 in the third embodiment shown in FIG. 6(*a*), and FIG. 7, in addition to the bias voltage control carried out during an initializing operation in the above-described second embodiment, the speed with which the development roller 4 of the developing device 3 is rotated in Step S4 in FIG. 4 was made slower than the speed with which the development roller 4 is rotated during an image forming operation. In the above-described second embodiment, −400 V was applied to the development roller 4, and −300 V was applied to the regulation blade 8. Further, −600 V was applied to the toner supply roller 5. In this embodiment, in addition to the above-described bias voltage control, the speed with which the development roller 4 is rotated during an initializing operation was reduced to 33 rpm, whereas in the first and second embodiments, it was 100 rpm which is the same as the rotational speed of the development roller 4 for an image forming operation. By the way, to the toner supply roller 5, −400 V was applied.

An initializing operation is such an operation that is carried out from when the development roller 4 begins to be rotationally driven to when the peripheral surface of the development roller 4 is supplied with a preset amount of toner 10. During the initializing operation in this embodiment, the development roller 4 is rotated at 30 rpm, which is substantially slower than 100 rpm which is the fastest of the speeds with which the development roller 4 of the developing device 3 is rotatable while the image forming apparatus 100 is actually forming images.

That is, the development roller 4 is sometimes changed in rotational speed according to the image formation condition. For example, when an image is printed on a sheet of cardstock, it sometimes takes a longer time than when an image is printed on a sheet of ordinary printing paper. Thus, it is possible to structure that image forming apparatus 100 (developing device 3) so that when an image is printed on a sheet of ordinary printing paper, the speed for the development roller 4 is set to 100 rpm, or the fastest one, whereas when an image is printed on a sheet of cardstock, the speed of the development roller 4 is set (reduced) to 33 rpm.

If the image forming apparatus 100 (developing device 3) is structured as described above, the speed with which the development roller 4 is rotated during an initializing operation has only to be set to 33 rpm which is the same as the development roller 4 is rotated when an image is printed on a sheet of cardstock. It is also possible to structure the image forming apparatus 100 (developing device 3) so that the speed with which the development roller 4 is rotated during an image forming operation is fixed to 100 rpm. In such a case, the image forming apparatus 100 (developing device 3) may be structured so that the development roller 4 can be rotated at a slower speed which is exclusively for an initializing operation.

By reducing the speed with which the development roller 4 is rotated during an initializing operation (relative to fast speed for image formation) as described above, it is possible to reduce the amount by which the coating agent 50 slips by the development bias as the development roller 4 is rotated. In other words, it is possible to increase the amount by which the coating agent 50 is regulated by the regulation blade 8. Thus, it is possible to collect and keep the coating agent 50 in the immediate adjacencies of the toner capturing portion of the regulation blade 8 by a greater amount.

Referring to FIG. 7, according to the experiments in which the developing device 3 in this embodiment was tested, the vertical streaks did not occur when the amount of the coating agent 50 on the development roller 4 was in a range of 5 mg - 90 mg, which is wider than the range in which the vertical streaks did not occur when the developing devices 3 in the first and second embodiments were tested. That is, even though the amount by which the peripheral surface of the development roller 4 is coated with the coating agent 50 before the developing device 3 is shipped out of its factory is reduced compared to the first and second embodiment, excellent results were obtained. That is, the foreign substances such as dust, paper burrs and the like, were blocked, and therefore, vertical streaks did not occur.

By the way, if such bias voltage that works in such direction that the toner 10 is moved from the development roller 4 to the regulation blade 8 is applied between the development roller 4 and regulation blade 8, there occurs a problem that the peripheral surface of the development roller 4 is too thinly coated with the toner 10, and therefore, solid images outputted by the image forming apparatus 100 will be insufficient in density. Further, if the printing operation by the image forming apparatus 100 is continued with the bias voltage similarly set, there occurs a problem that as print count reaches roughly 1,000, the toner 10 solidly adheres to the regulating edge of the regulation blade 8. In this embodiment, during an initializing operation, which is not a part of an image forming operation, the controller 25 sets the voltage application sections 21-23 to apply the bias voltages for an initializing operation. This setting can be done in a relatively short length of time, while the image forming apparatus 100 is prepared for an image forming operation.

By the way, in this embodiment, when the peripheral surface of the development roller 4 of the fresh developing device 3 was not coated with the coating agent 50, the amount of torque necessary to drive the developing device 3 was substantial, which results in the occurrence of such a problem that the regulation blade 8 is damaged. This is why an example in which the peripheral surface of the development roller 4 was coated with the coating agent 50 before the developing device 3 was shipped out of its factory was described.

On the other hand, even in a case where the peripheral surface of the development roller 4 of the fresh developing device 3 is not coated with the coating agent 50, the occurrence of the vertical streaks can be reduced by carrying out such a bias voltage control as those in the preceding embodiment that collects and keeps developer along the regulating edge of the regulation blade 8.

This is possible because the above-described bias voltage control is effective to keep virtually the entirety of the minuscule amount of the toner 10 supplied from the toner storage chamber 18*b* to the development chamber 18*a*, along the regulating edge of the regulation blade 8. Therefore, it is possible to prevent the foreign substances from entering the interface between the regulation blade 8 and development roller 4 until the amount by which the toner is supplied to the interface becomes large enough to fill up the toner capturing area, which is in the immediate adjacencies of the regulating edge (toner catching portion) of the regulation blade 8. Therefore, it is possible to reduce the occurrence of the vertical streaks.

According to this embodiment, the following control is carried out from when the fresh developing device 3 begins to be driven to when the peripheral surface of the developing device 3 is supplied with a preset amount of toner 10. That is, the controller 25 appropriately controls the bias voltages to be applied to the development roller 4, regulation blade 8, and toner supply roller 5, with the use of the voltage application sections 21-23, one for one.

Therefore, it is possible to collect and keep the coating agent 50 or toner 10 along the toner capturing portion of the regulation blade 8. Therefore, it is possible to prevent foreign substances entering the toner (coating agent) catching area, which extends along the regulating edge of the regulation blade 8. Therefore, it is possible to prevent the occurrence of the vertical streaks.

[Effects of Present Invention]

Lastly, the effects provided by the above-described embodiments of the present invention can be summarized as follows. According to each of the above-described embodiments of the present invention, with the use of the bias voltage control carried out during an initializing operation, it is possible to keep a sufficient amount of coating agent in the toner capturing area which extends along the regulating edge of the developer regulating member. Therefore, it is possible to prevent foreign substances from entering between the developer bearing member (development roller) and regulating member (regulation blade). Therefore, it is possible to control the occurrence of the vertical streaks.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-044519 filed on Mar. 7, 2014, which is hereby incorporated by reference herein in its entirety.

What is claimed is:

1. An image forming apparatus comprising:

a developing device detachably mountable to a main assembly of said image forming apparatus, said developing device including, a developer accommodating container for accommodating a developer, a developer carrying member for carrying the developer, and a developer feeding member, provided in contact with said developer carrying member, for supplying the developer to said developer carrying member, a developer regulating member for regulating the developer carried on said developer carrying member; and a voltage applying device capable of applying to said developer carrying member and said developer regulating member respective voltages different from each other, wherein said image forming apparatus carries out, when a fresh developing device is mounted to said main assembly, an initial installing operation in which the developer carrying member is rotated, and wherein in the initial installing operation, said voltage applying device applies, to at least one of said developer carrying member and said developer regulating member, a voltage for the initial installing operation which is different from the voltage for normal image forming operation, so as to urge a material applied to said developer carrying member in the fresh developing device toward said developer regulating member from said developer carrying member.

2. An apparatus according to claim 1, wherein in the initial installing operation, said voltage applying device further applies to said developer feeding member a voltage which is different from the voltage applied to said developer carrying member, so as to urge the material toward said developer carrying member from said developer feeding member.

3. An apparatus according to claim 2, wherein the material is the developer or a material chargeable to a polarity which is the same as a charging polarity of said developer, and wherein the voltage applied to said developer feeding member in the initial installing operation has a polarity relatively the same as the charging polarity of the developer relative to the voltage applied to said developer carrying member in the initial installing operation.

4. An apparatus according to claim 2, wherein the material is the developer or a material chargeable to a polarity which is the same as a charging polarity of said developer, and wherein the voltage applied to said developer feeding member in the initial installing operation has a polarity relatively the same as a charge polarity of the developer relative to a voltage applied to said developer feeding member during the normal image formation.

5. An apparatus according to claim 1, wherein during application of the voltage for the initial installation operation by said voltage applying device, said developer carrying member is rotated at a speed lower than at least a highest speed at which said developer carrying member rotates during a printing operation of said image forming apparatus.

6. An apparatus according to claim 1, wherein the material is the developer or a material chargeable to a polarity which is the same as a charging polarity of the developer.

7. An apparatus according to claim 6, wherein the voltage applied to said developer regulating member in the initial installing operation has a polarity relatively opposite the charging polarity of the developer relative to the voltage applied to said developer carrying member in the initial installing operation.

8. An apparatus according to claim 7, wherein the voltage applied to said developer regulating member in the initial installing operation has a polarity relatively opposite a charge polarity of the developer relative to a voltage applied to said developer regulating member during the normal image formation.

9. An apparatus according to claim 7, wherein a voltage applied to said developer regulating member during the normal image formation has a polarity relatively the same as the charge polarity of the developer relative to the voltage applied to said developer carrying member during the normal image formation.

10. An apparatus according to claim 1, wherein the material comprises powder different from the developer.

11. An apparatus according to claim 1, wherein the material comprises silicone resin material.

12. An apparatus according to claim 1, wherein the material is the same as the developer accommodated in said developer accommodating container.

13. An apparatus according to claim 1, wherein the material is a developer different from the developer accommodated in said developer accommodating container.

14. An apparatus according to claim 1, further comprising an image bearing member for bearing a latent image, wherein said developing device develops the latent image.

15. An apparatus according to claim 14, further comprising a process cartridge including said image bearing member and said developing device, wherein said developing device is mounted and demounted relative to said main assembly as a part of said process cartridge.

16. An apparatus according to claim 1, wherein in the initial installing operation, the developer accommodated in said developer accommodating container is supplied to said developer carrying member during application of the voltage for the initial installing operation.

* * * * *